US011680690B2

(12) United States Patent
Ludwiczak et al.

(10) Patent No.: US 11,680,690 B2
(45) Date of Patent: Jun. 20, 2023

(54) ELONGATE LIGHT FIXTURE

(71) Applicant: ZUMTOBEL LIGHTING GMBH, Dornbirn (AT)

(72) Inventors: Bogna Ludwiczak, Opfenbach (DE); Matthias Covi, Reuthe (AT)

(73) Assignee: Zumtobel Lighting GmbH, Dornbirn (AT)

( * ) Notice: Subject to any disclaimer, the term of this patent is extended or adjusted under 35 U.S.C. 154(b) by 0 days.

(21) Appl. No.: 17/792,426

(22) PCT Filed: Feb. 5, 2021

(86) PCT No.: PCT/EP2021/052890

§ 371 (c)(1),
(2) Date: Jul. 13, 2022

(87) PCT Pub. No.: WO2021/165068

PCT Pub. Date: Aug. 26, 2021

(65) Prior Publication Data

US 2023/0067580 A1 Mar. 2, 2023

(30) Foreign Application Priority Data

Feb. 19, 2020 (DE) ..... 20 2020 100 899.4

(51) Int. Cl.
*F21S 4/28* (2016.01)
*F21V 7/00* (2006.01)
(Continued)

(52) U.S. Cl.
CPC ..... *F21S 4/28* (2016.01); *F21V 7/0083* (2013.01); *F21Y 2103/10* (2016.08); *F21Y 2115/10* (2016.08)

(58) Field of Classification Search
CPC ..... F21S 4/28; F21V 7/0083; F21Y 2103/10; F21Y 2115/10
See application file for complete search history.

(56) References Cited

U.S. PATENT DOCUMENTS

2004/0085779 A1* 5/2004 Pond ..... F21V 29/75 362/516
2010/0252848 A1* 10/2010 Liang ..... H01L 33/54 438/27

(Continued)

FOREIGN PATENT DOCUMENTS

EP 2636943 9/2013
KR 101275514 6/2013

OTHER PUBLICATIONS

PCT/EP2021/052890, International Search Report and Written Opinion dated Apr. 23, 2021,8 pages.

*Primary Examiner* — Evan P Dzierzynski
(74) *Attorney, Agent, or Firm* — Andrus Intellectual Property Law, LLP

(57) ABSTRACT

The invention relates to a light fixture (100) having: an elongate light source, which is formed by multiple LEDs (60) or LED clusters arranged one behind the other in the longitudinal direction; a primary optical system (20), which is assigned to the light source and is formed by multiple pot-like reflectors (25), which are arranged one behind the other in the longitudinal direction and each widen in a divergent manner from the light source in a light emission direction of the light fixture (100); and a secondary optical system (30), which follows the primary optical system (20) in the light emission direction and is formed by a planar element consisting of a transparent material, wherein the element has light-refractive structures (35).

8 Claims, 4 Drawing Sheets

(51) Int. Cl.
*F21Y 103/10* (2016.01)
*F21Y 115/10* (2016.01)

(56) References Cited

U.S. PATENT DOCUMENTS

2011/0141733 A1* 6/2011 Senn ..... A61C 19/004
362/235
2011/0182085 A1* 7/2011 Ko ..... F21S 4/28
257/88
2013/0070478 A1* 3/2013 Edamitsu ..... F21V 5/02
362/311.06
2013/0194812 A1* 8/2013 Tseng ..... F21V 29/763
362/355
2018/0022268 A1 1/2018 Xie

* cited by examiner

ELONGATE LIGHT FIXTURE

CROSS-REFERENCE TO RELATED APPLICATION

The present application is the U.S. national stage application of international application PCT/EP2021/052890 filed Feb. 5, 2021, which international application was published on Aug. 26, 2021 as International Publication WO 2021/165068 A1. The international application claims priority to German Patent Application 20 2020 100 899.4 filed Feb. 19, 2020.

TECHNICAL FIELD OF THE INVENTION

The present invention relates to an elongate light fixture, by means of which a large quantity of light is to be emitted without glare via a narrow light exit region.

BACKGROUND OF THE INVENTION

Linear lighting solutions are used in a wide variety of ways in lighting technology and are provided both in the form of individual light fixtures and in the form of elongate so-called light strips. Because of their narrow design, such light fixtures or light strips are often characterized by their elegant appearance in comparison to large-area light fixtures, which is why they are used in a wide variety of applications.

If light fixtures of this type are to be used to illuminate workplaces, it is necessary that a correspondingly large quantity of light be emitted in order to be able to meet the requirements of normal workplace lighting. In this respect, the common solution to date for realizing a narrow linear light fixture has then been to use a plurality of LED modules which are arranged one behind the other and enclosed by a white or mirrored trough reflector. Underneath the reflector, there is then an optical sandwich consisting of diffuser foils and light-refractive structures in order to ensure the glare reduction needed for lighting workplaces. The pot-like reflectors assigned to the LEDs have alternatively also been used to influence the light but are then open to the underside and thus allow a direct view into the light fixture.

At present, there is a clear tendency to make the light fixtures narrower and narrower, while nonetheless continuing to increase the quantity of light emitted. For example, it would be desirable to provide light fixtures, the light exit region of which has a width in the order of only about 30 mm. At the same time, however, the light-emitting surface of the light fixture should have an appearance that is as homogeneous as possible, which excludes the use of the aforementioned individual reflectors which are open to the underside. Instead, solutions are being sought in which a large quantity of light can be emitted, despite the narrow light exit opening and the homogeneous emission of light, that also meets the requirements in terms of glare reduction suitable for work purposes.

SUMMARY OF THE INVENTION

The underlying object of the present invention is to provide a corresponding light fixture that fulfills the aforementioned criteria in terms of its emission of light.

This object is achieved with a light fixture having the features of claim 1. Advantageous developments of the invention are the subject matter of the dependent claims.

In the solution according to the invention, the elongate light source is formed by a plurality of LEDs or LED clusters arranged one behind the other in the longitudinal direction. A homogeneous emission of light over the entire surface of the elongate, narrow light exit opening is achieved by means of a plate-shaped element which consists of a transparent material and has light-refractive structures. According to the invention, however, the use a primary optical system formed by a plurality of pot-like reflectors, which are arranged one behind the other in the longitudinal direction and respectively widen in a divergent manner from the light source in a light emission direction of the light fixture, is provided in front of this plate-shaped element. It has been shown that efficient influencing of the light can be achieved via the interaction of the pot-like reflectors with the light-refractive secondary optical system, even at high so-called lumen outputs, such that the light ultimately emitted by the light fixtures meets the requirements in terms of satisfactory glare reduction, in particular such that the condition UGR<19 can be met.

Thus, according to the present invention, a light fixture is proposed which has:

- an elongate light source, which is formed by a plurality of LEDs or LED clusters arranged one behind the other in the longitudinal direction,
- a primary optical system, which is assigned to the light source and is formed by a plurality of pot-like reflectors, which are arranged one behind the other in the longitudinal direction and respectively widen in a divergent manner from the light source in a light emission direction of the light fixture,
- a secondary optical system, which follows the primary optical system in the light emission direction and is formed by a plate-shaped element consisting of a transparent material, wherein the plate-shaped element has light-refractive structures.

The light-refractive structures of the secondary optical system can in particular be prism-like structures, particularly preferably pyramid-shaped prism structures. Such structures are already known per se and serve to widen in a controlled manner the light distribution of a beam entering on the input side and to reduce glare. It has now been shown that the glare reduction efficiency of such scattering structures is highest when the incident light strikes the secondary optical system in a nearly ideally bundled manner. This object is achieved according to the invention by using the primary optical system, which, by means of the pot-like reflectors, deflects the light emitted by the LEDs or LED clusters into nearly perfectly parallel light beams. This enables a highly efficient influencing of the light output which, in particular also in the case of large quantities of light and narrow light exit openings, ensures the desired, glare-free light distribution.

It is preferably provided that the pot-like reflectors have light exit openings which lie in a common plane, wherein the secondary optical system is then arranged at a distance to this plane, in particular at a distance of about 4 mm. This measure ensures that no individual beams strike the light entry side of the secondary optical system; instead, overlap occurs in the transition region between two adjacent pot-like reflectors, as a result of which differences in luminance are reduced or compensated. Thus, the overall appearance of the light-emitting region of the light fixture is homogenized.

It is preferably provided that when viewed in the longitudinal direction, the pot reflectors have side wall regions which have a parabolic shape, wherein the LEDs or LED clusters are then arranged at the focal point of this parabolic shape. In this case, the parabolic shape then ensures particularly efficient bundling of the light, which, as explained above, is important in terms of the mode of action of the secondary optical system.

In principle, a corresponding parabolic shape of the pot-like reflectors in the transverse direction of the light fixture would also be advantageous. However, since the spacing between the individual LEDs or LED clusters should be relatively small in order to achieve a large quantity of light and the pot-like reflectors are consequently close together, two adjacent reflectors would overlap if the reflector walls had a continuous parabolic shape. In order to avoid this and nonetheless enable a compact arrangement of the LED light sources, it is therefore provided according to a development of the invention that the side wall regions, extending transversely to the longitudinal direction of the light fixture, of the pot-like reflectors merge into inclined, flat side surfaces.

The pot-like reflectors respectively have light entry openings, wherein one LED or one LED cluster is then assigned to each light entry opening. As already stated, in the case of parabolically shaped reflector walls, the LEDs or LED clusters are then at the focal point of the parabola.

In order to additionally make the appearance of the light fixture more homogeneous, it can furthermore be provided that an additional light-scattering element, in particular a diffuser foil, is arranged between the primary optical system and the secondary optical system. This diffuser foil can, for example, be arranged on the light entry side of the secondary optical system such that it rests on said optical system.

The light fixture according to the present invention preferably has an elongate housing which forms a narrow light exit opening, wherein the light exit opening is completely closed by the secondary optical system or a light-permeable cover which rests against the secondary optical system. All of the light exiting the light fixture is thus influenced in the desired manner by the above-described measures according to the invention, so that a large quantity of light of high quality can nonetheless be emitted, even with a preferred width of the light exit opening of about 3 cm.

BRIEF DESCRIPTION OF THE DRAWINGS

The invention is explained in more detail below with reference to the accompanying drawing. Shown are.

DETAILED DESCRIPTION OF THE PREFERRED EMBODIMENT

The concept according to the invention is explained below on the basis of an elongate individual light fixture, which is provided for lighting an office workplace, for example, and is intended to emit light of high intensity, but nonetheless homogeneously, via a narrow light exit surface in such a glare-reduced manner that a so-called UGR value of below 19 is achieved. This UGR value (Unified Glare Rating) describes the psychological glare effect of a lighting system in a certain observer position, wherein the UGR value of 19 is relevant to office spaces and should not be exceeded so as to be able to ensure glare-free work at a screen workstation.

However, it should be noted that the concept, described below, for influencing light is not limited to the shown individual light fixture and corresponding applications but can be used whenever high-intensity light is to be emitted homogeneously via a relatively narrow surface in such a way that the risk of glare for an observer is avoided to the greatest possible extent. The use of the optical concept described below would in particular also be suitable for so-called elongate light strips, for example, by means of which narrow elongate strips are formed in a wall or ceiling region of a space, light being emitted homogeneously over the entire length of said strips.

Figure 1:
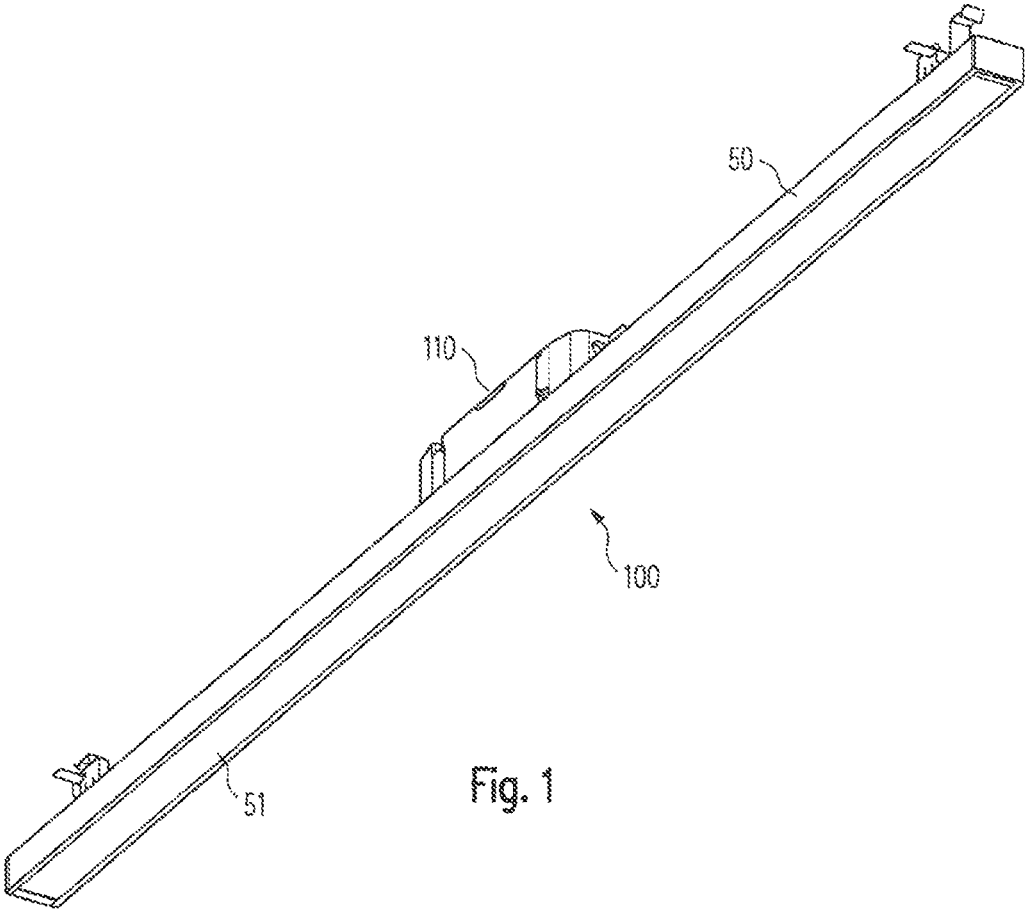
FIG. 1 is an exemplary embodiment of a light fixture according to the invention in a perspective view.
Figure 2:
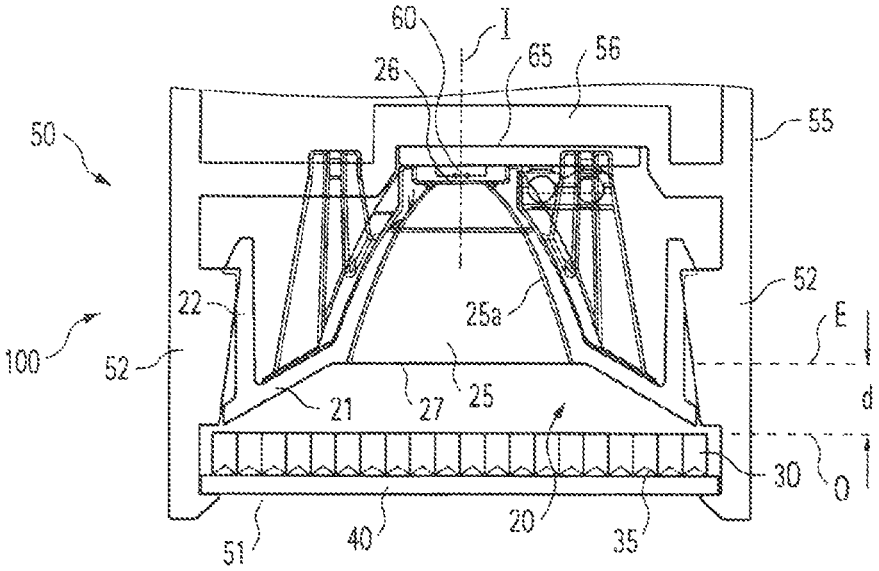
FIG. 2 is a sectional view of the light fixture according to the invention in the transverse direction.
Figure 3:
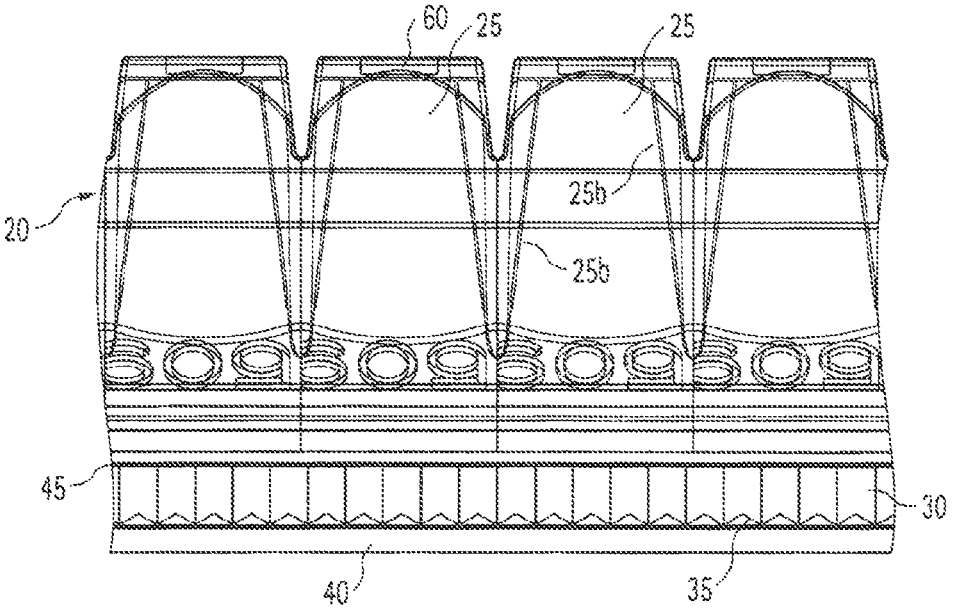
FIG. 3 is a sectional view of the light fixture according to the invention in the longitudinal direction.

The light fixture 100 shown in a perspective view in FIG. 1 and also in a sectional view in FIGS. 2 and 3 first has an elongate housing 50, which is substantially formed by an elongate profile part 55. This profile part 55, which is designed for attachment to a mounting rail in the shown exemplary embodiment but could also be mounted in the same way on or in the ceiling of a space or suspended, is C-shaped or H-shaped in cross-section and thus forms an elongate accommodation space for mounting the components responsible for generating and emitting light. Also arranged on the upper side of the profile part 55 is an operating device 110, which converts the supply voltage provided to the light fixture 100 into a suitable operating voltage for the lighting means.

For example, the profile part 55 here consists of an appropriate extruded profile, for example made of aluminum, although other materials would also be conceivable. An elongated light exit opening 51, via which the light of the light fixture 100 is emitted, is defined on the underside of the housing 50 by the two side walls 52 of the profile part 55. As already mentioned, it is desired here that light be emitted uniformly homogeneously over the entire length and width of the light exit opening 51, wherein the width of the light exit opening 51 should be as narrow as possible, preferably in the order of about 3 cm. Nonetheless, intense light should be emitted with a lumen output of about 2000 lm/m.

LEDs 60, which are positioned in the longitudinal direction of the housing 50 on one or more LED circuit boards 65 arranged one behind the other, are used as lighting means in the light fixture 100 according to the present invention. In the following, it is assumed that they are all individual LEDs 60. However, it would also be conceivable for LED clusters consisting of a plurality of LEDs to be used instead of these individual LEDs 60. If they are configured to emit light in different colors or color temperatures, it would be possible as a part of an individual control of the various LEDs to influence the color or color temperature of the light emitted by the light fixture 100 overall. The LED circuit board(s) 65 is/are arranged here on a web 56 which extends substantially horizontally through the profile part 55.

The influencing according to the invention of the light produced by the LEDs 60 takes place by means of an optical system 10, the structure and function of which is explained in more detail below. The optical system 10 here substantially consists of two components, on the one hand, a primary optical system 20 which is assigned directly to the LEDs 60, and on the other hand, a secondary optical system 30 which is located in the region of the light exit opening 51 of the light fixture 100.

Figure 4:
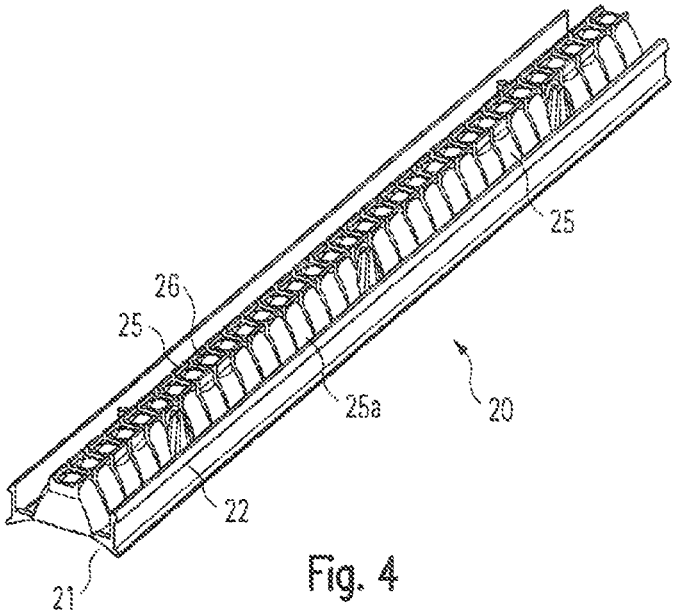
FIGS. 4 and 5 are two perspective views of the component forming the primary optical system.
Figure 5:
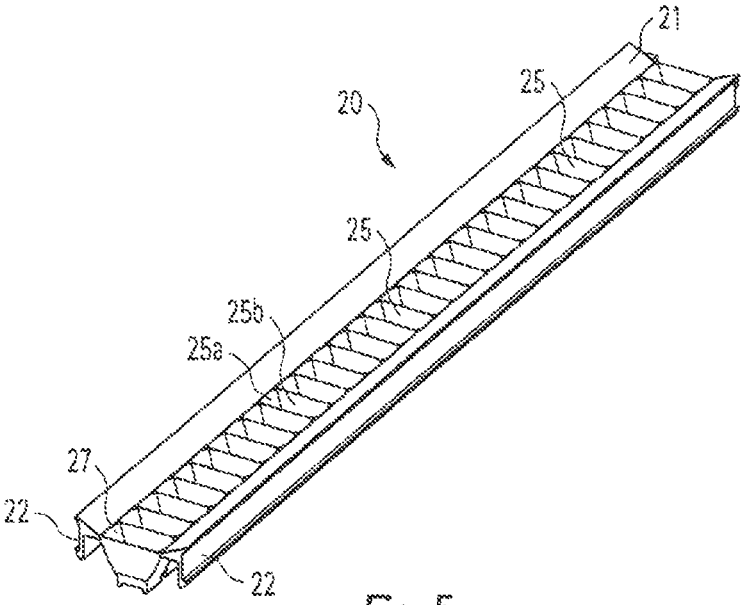

The configuration and the mode of action of the primary optical system 20 is explained first in the following. This is a component which is also shown separately in FIGS. 4 and 5 and forms a plurality of pot-like reflectors 25, which are arranged one behind the other in the longitudinal direction of the light fixture 100 and, in a first step, are intended to achieve a bundling of the light emitted by the LEDs 60. This primary optical system 20 is preferably formed by an injection-molded plastic part, which is then accordingly highly reflectively coated or mirrored. A plurality of the pot-like reflectors 25, preferably all, are combined into one piece to form the shown component.

The configuration of the primary optical system 20 here is such that one reflector pot 25 is assigned to each LED 60 (or each LED cluster) and is intended to appropriately bundle the light of this LED 60. On its side facing the LEDs 60, the reflector pot 25 here has a light entry opening 26, in which the LED 60 is positioned or into which the LED 60 accordingly projects. Starting from this light entry opening 26, the side walls of the reflector pot 25 extend downward in a divergent manner, i.e., they widen in the light emission direction of the light fixture 100, wherein they each enclose a respective light exit opening 27 at the lower end. As can in particular be seen in FIGS. 2, 4 and 5, lateral webs 21 with latching arms 22 which are arranged thereon and via which latching with corresponding projections of the profile part 55 forming the housing 50 takes place, extend from the lateral regions of these light exit openings 27. A simple, tool-free fastening of the primary optical system 20 in the light fixture housing 50 is thus made possible.

The webs 21 are inclined outward in such a way that they do not perform any significant function for the emission of light. At best, beams reflected or scattered at the surface of the secondary optical system 30 described in more detail below could still also be reflected at these surfaces. However, as explained below, the actual light influencing takes place by the side walls of the pot-like reflectors 25.

The function of the pot reflectors 25 is to bundle the light emitted by the LEDs 60 as tightly as possible, in particular such that the resulting beam has a so-called full width at half maximum (FWHM) of less than 10°. A correspondingly strong bundling of the light can, for example, be achieved by the highly reflectively configured side walls of the pot reflectors 25 having a parabolic shape, i.e., following the shape of a parabola, wherein the LEDs 60 are arranged at the focal point of the parabola.

In the primary optical system 20 of the light fixture 100 according to the invention, it is accordingly provided that in particular the wall regions 25*a* of the pot reflectors that are lateral wall sections with respect to the longitudinal direction of the light fixture 100 have this parabolic shape and are rotationally symmetrical with respect to the central axis I (see FIG. 2).

The pot reflectors 25 should ideally be rotationally symmetrical all the way around. However, as mentioned at the outset, the intent is for the present light fixture 100 to produce and emit a relatively large quantity of light, which leads to the LEDs 60 or LED clusters being arranged one behind the other in the longitudinal direction of the light fixture 100 with a relatively small spacing. This small spacing of the LEDs 60 requires that said LEDs would correspondingly overlap if the pot reflectors 25 are entirely rotationally symmetrical. In order to avoid this, it is therefore provided that the respective side wall regions 25*b* merge from the parabolic shape to a planar shape in a direction transverse to the longitudinal direction of the light fixture 100, as can be seen in FIG. 3 in particular.

The pot reflectors 25 as a whole are thus formed by two different side wall regions 25*a*, 25*b*; on the one hand, the wall regions 25*a*, which are lateral in relation to the longitudinal center plane of the light fixture 100 and are entirely parabolic or parabolic over their full height and are rotationally symmetrical with respect to axis I, and on the other hand, the wall regions 25*b*, which extend transversely thereto and merge into a planar shape and thereby form the V-shaped transverse lamellar structures that can be seen in FIG. 3.

Figure 6A:
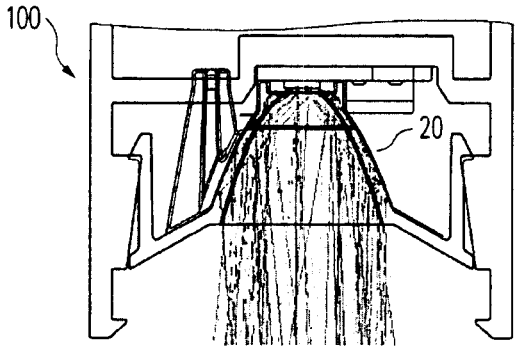
FIG. 6*a* shows the influencing, by the primary optical system, of the light emitted by the LEDs.
Figure 6B:
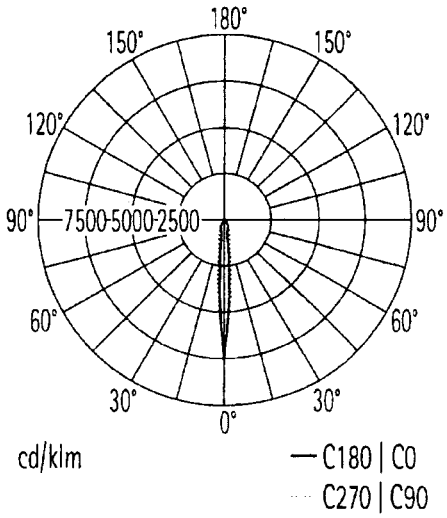
FIG. 6*b* shows the light distribution that can be achieved by the primary optical system.

The effect of the primary optical system 20 on the light emitted by the associated LEDs 60 is shown in FIGS. 6*a* and 6*b*, wherein FIG. 6*a* shows the simulated beam path of the LED light, whereas FIG. 6*b* shows the resulting light distribution curve. The beam path in FIG. 6*a* already shows that the light initially emitted by the LEDs 60 in a wide angular range is reflected by the side wall regions 25*a* and 25*b* of the pot reflectors 25 such that it is directed downward as a nearly perfect parallelized beam. This is also shown by the corresponding light distribution curve in FIG. 6*b*, which shows an extremely strong bundling of the light with an extremely small full width at half maximum. It can also be seen that the planar design of the transversely aligned side wall regions 25*b* has no negative effects on the bundling of the light and that the light beams are also efficiently parallelized in the longitudinal direction of the light fixture 100.

The light bundled in the above-described manner is then modified in the further course by the aforementioned secondary optical system 30, in particular expanded, before it is emitted via the light emission opening 51 of the light fixture 100. This secondary optical system 30 is a microprism plate which is formed of a transparent material and has pyramid-like microprism structures 35 on its surface facing away from the LEDs 60. The angle of inclination of the individual pyramids is in the range of 111°. Such structures are already known per se and are widely used in lighting technology. They are used to slightly direct the incident light in order to adapt the light output to a desired light distribution and glare reduction.

For the light fixture 100 according to the invention, it is now essential that the mode of action of the secondary optical system 30 is the better the more strongly bundled the incident light is. This is the reason the pot reflectors 25 of the primary optical system 20 are configured in the above-described manner to bundle the light emitted by the LEDs 60 extremely strongly.

Figure 7A:
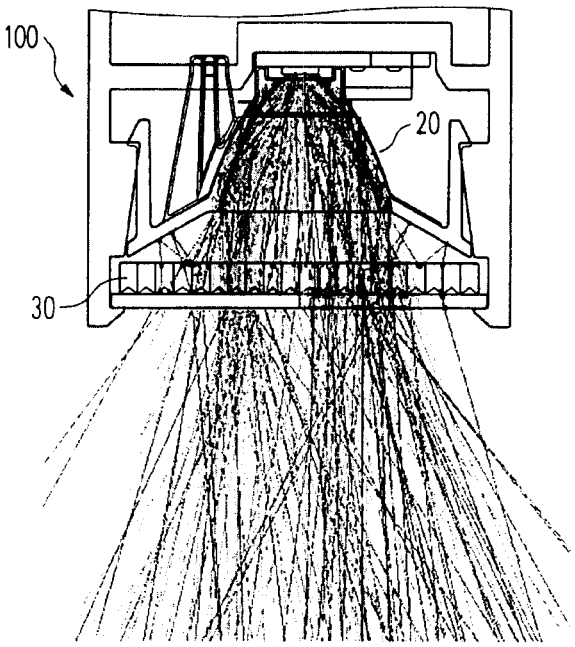
FIG. 7*a* shows the further influencing of the light by the secondary optical system.
Figure 7B:
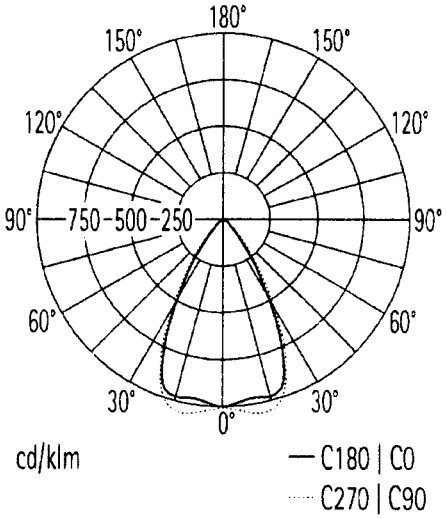
FIG. 7*b* shows the distribution of the light ultimately emitted by the light fixture according to the invention.

The incident light can then be directed through the prism structures 35 in a defined manner, as can be seen in FIGS. 7*a* and 7*b*. These figures show the beam path of the light as well as the ultimately resulting light distribution in a manner analogous to FIGS. 6*a* and 6*b*. It can be seen that the initially strongly parallelized light is expanded again by the pyramid-shaped prism structures 35 and emitted over a desired angular range, wherein, however, said range is selected such that a full width at half maximum of about 60° is not exceeded and the requirement for an UGR value of below 19 is thus met.

However, this controlled expansion is only possible because of the light beam that is tightly bundled by the primary optical system 20. The combination of primary optical system 20 and secondary optical system 35 therefore enables a very large quantity of light to be emitted via the light exit opening 51 of the light fixture 100 and nonetheless to correspond to a desired light distribution, in particular a light distribution that can be used to illuminate office workplaces.

As can furthermore be seen from the figures, the light exit openings 27 of the pot reflectors 25 that lie in a common plane E have a certain distance d from the surface O of the secondary optical system 30 (see FIG. 2). This distance d is necessary to prevent the beams produced by the pot reflectors 25 from striking the secondary optical system 30 separately. Instead, light can now also strike regions of the secondary optical system 30 which are not directly below the opening 27 of a pot reflector 25. The distance d, preferably in the range of about 4 mm, between the two optical components 20 and 30 thus ensures that light is emitted homogeneously over the entire length of the light fixture 100. This means that the light exit opening 51 appears substantially uniformly bright over the entire length and width.

In the shown exemplary embodiment, the secondary optical system 30 does not constitute the final light exit element of the light fixture 100. Instead, a planar cover 40, which consists of a transparent material and is arranged in the region of the light exit opening 51 of the housing 50 and on which the secondary optical system 30 is mounted, is provided for this purpose. However, this cover 40 is of no further importance for the emission of light because it is not intended to significantly affect the light beams.

It can furthermore be provided that a diffuser foil or, more generally, a light-scattering element 45, is positioned on the upper side, facing the LEDs 60, of the secondary optical system 30. This is intended to prevent a direct view into the light fixture 100 so that the individual LEDs 60 or LED clusters and the individual pot reflectors 25 are not visible to an observer. However, just like the cover 40, this only slightly scattering foil 45 is not intended to significantly influence the previously explained function of the primary optical system 20 and of the secondary optical system 30.

Overall, the optical concept according to the invention thus opens up the possibility of forming light fixtures with extremely narrow light exit openings (for example, in the range of only about 3 cm), which nonetheless emit a very large quantity of light homogeneously and without glare.

The invention claimed is:

1. A light fixture (100) having:

an elongate light source, which is formed by a plurality of LEDs (60) or LED clusters arranged adjacent to one another in the longitudinal direction;

a primary optical system (20), which is assigned to the light source and is formed by a plurality of pot-like reflectors (25), which are arranged adjacent to one another in the longitudinal direction and respectively widen in a divergent manner from the light source in a light emission direction of the light fixture (100); and a secondary optical system (30), which follows the primary optical system (20) in the light emission direction and is formed by a plate-shaped element consisting of a transparent material, wherein the element has light-refractive structures (35);

wherein the pot-like reflectors (25) have side wall regions (25*a*) which have a parabolical shape when viewed in the longitudinal direction and side wall regions (25*b*) which are inclined in a direction perpendicular to the longitudinal direction.

2. The light fixture according to claim 1, wherein the light-refractive structures (35) are pyramid-shaped prisms.

3. The light fixture according to claim 1, wherein the pot-like reflectors (25) have light exit openings (27) which lie in a common plane (E), and wherein the secondary optical system (30) is arranged at a distance (d) to this plane (E).

4. The light fixture according to claim 1, wherein the pot-like reflectors (25) have light entry openings (26), wherein each light entry opening (26) is assigned to an LED (60) or an LED cluster.

5. The light fixture according to claim 1, wherein all of the pot-like reflectors (25) are combined to form a one-piece, injection-molded plastic part.

6. The light fixture according to claim 1 characterized in that a light-scattering element (45), comprising a diffuser foil, is arranged between the primary optical system (20) and the secondary optical system (30).

7. The light fixture according to claim 1, further having an elongate housing (50) which forms a light exit opening (51), wherein the light exit opening (51) is completely closed by the secondary optical system (30) or a light-permeable cover (40) which rests against the secondary optical system (30).

8. The light fixture according to claim 7, wherein the light exit opening (51) has a width of approximately 3 cm.

* * * * *